United States Patent [19]

Bustos et al.

[11] 3,939,987

[45] Feb. 24, 1976

[54] SOLID PLASTIC FOAM MERCHANDISE SUPPORT

[75] Inventors: Rafael T. Bustos, Atlanta; Ladd M. Orr, Clarkston, both of Ga.

[73] Assignee: Leggett & Platt, Incorporated, Carthage, Mo.

[22] Filed: May 13, 1974

[21] Appl. No.: 469,741

Related U.S. Application Data

[63] Continuation of Ser. No. 217,056, Jan. 11, 1972, abandoned.

[52] U.S. Cl. ..... 211/134; 211/49 R

[51] Int. Cl.[2] ..... A47F 7/00

[58] Field of Search ..... 211/134, 149, 148, 135, 211/49 R, 49 S, 36, 74, 104; 264/45; 108/108; 297/244, 455, 454, 92, 219, 218, 229; 5/41

[56] References Cited

UNITED STATES PATENTS

| | | | |
|---|---|---|---|
| 2,231,346 | 2/1941 | Riesing et al. | 297/455 |
| 2,261,506 | 11/1941 | Scott | 297/244 |
| 2,620,861 | 12/1952 | Oothoudt | 297/455 X |
| 2,852,143 | 9/1958 | Taber | 211/49 S |
| 2,975,909 | 3/1961 | Foster | 211/135 X |
| 3,394,818 | 7/1968 | Fineberg et al. | 211/49 R X |
| 3,654,059 | 4/1972 | Zisblatt | 297/219 X |

FOREIGN PATENTS OR APPLICATIONS

| | | | |
|---|---|---|---|
| 792,088 | 8/1968 | Canada | 211/134 |

OTHER PUBLICATIONS

Ferrigno, *Rigid Plastic Foams*, Reinhold Publishing Corp., N.Y., pp. 124–136.

*Primary Examiner*—Ramon S. Britts
*Attorney, Agent, or Firm*—Wood, Herron & Evans

[57] ABSTRACT

An adjustable display support for soft drink bottles adjustably constructed from thick, tapered foam plastic material which may be cut to size by a saw. The foam plastic is laminated with a cover of lightweight sheet metal, plastic or any other sheet material or coated with a suitable plastic. The front of the vertical back member and the top of the bottom shelf member are inclined with respect to the respective other side thereof. The support may be installed on the permanent island or base in the supermarket and cut to size and there are strategically located double-sided adhesive tapes to hold things in place.

3 Claims, 8 Drawing Figures

SOLID PLASTIC FOAM MERCHANDISE SUPPORT

This is a continuation of application Ser. No. 217,056, filed Jan. 11, 1972, now abandoned.

BACKGROUND OF THE INVENTION

1. Field of the Invention

Supports and racks and particularly adjustable merchandise supports and racks (Class 211, for example Subclass 104).

2. Description of the Prior Art

The prior art consists of welded wire racks and racks made from structural members, such as wood or metal members, connected together and covered by plywood and the like. These racks are more expensive to manufacture than the present one, are heavy and bulky, and are not readily adjustable to fit different circumstances and different supermarkets or other stores. There is a demand for a lightweight, inexpensive merchandise rack which can be easily adapted (cut) to size and placed in any available space which might become available on short notice.

SUMMARY OF THE INVENTION

The merchandise support is easily set up in a supermarket or other place and readily adjusted (cut) to size with a tapered bottom shelf and an inclined or tapered upright back member so that bottles of soft drinks or other merchandise may be stacked and will incline toward the bottom rear corner to prevent displacement and dislodgement. Welded wire construction, screwed and bolted members, and nailed wooden boards, have been eliminated altogether. Solid lightweight (honeycomb) foam plastic material is formed with an inclined front and a straight back into panels which may be used both for the back and the bottom of the merchandise support. The foam plastic may be coated or laminated with sheet material on the exposed sides. Each panel may be cut to length with an ordinary stockman's knife, carpenter's saw, etc., and thereby made to fit any available space. Furthermore, doublesided adhesive tape may be used to tape sheet material in place as well as anything else that is desired.

Figures 1, 2, 3, 4, 5, 6, 7, 8:
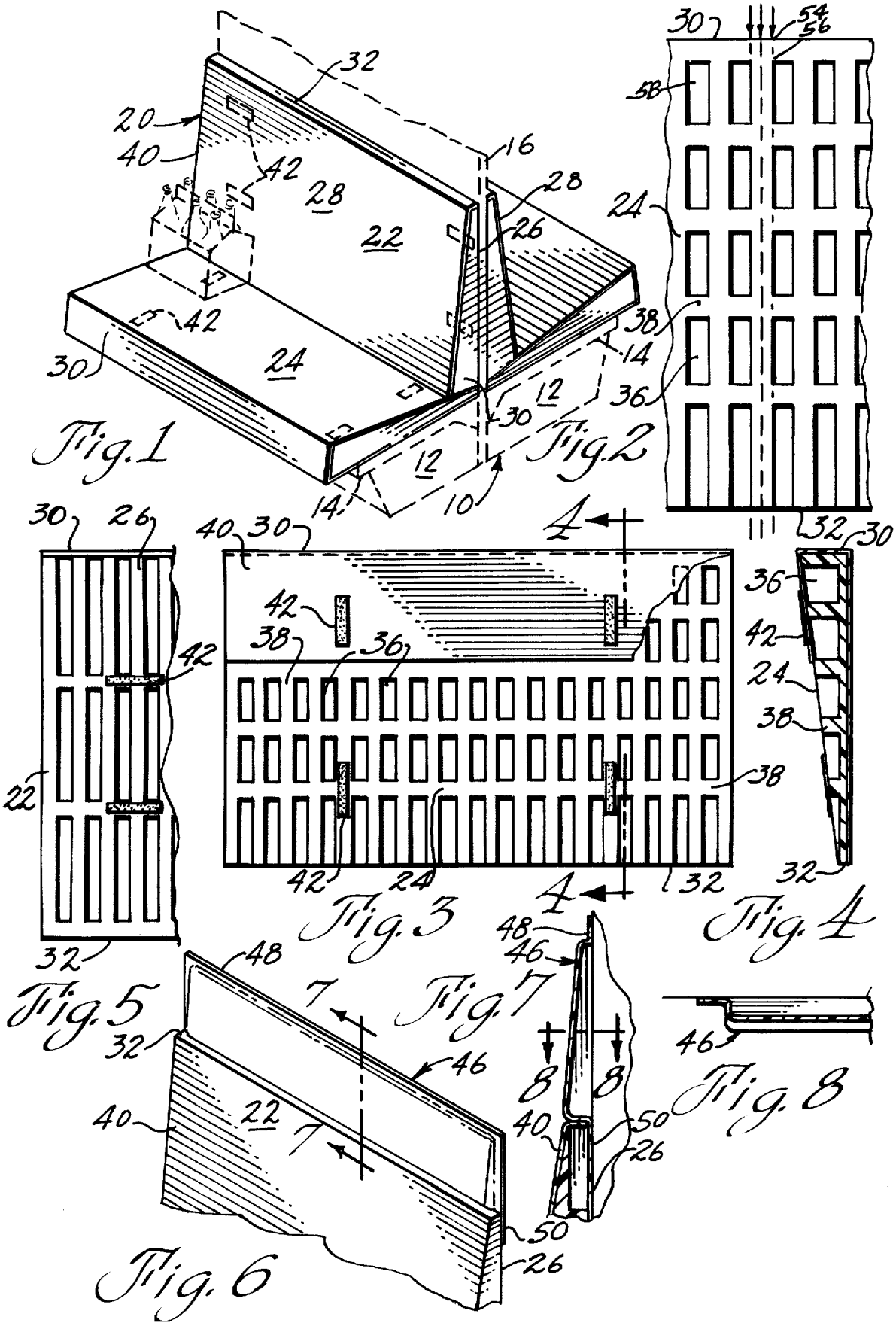
FIG. 1 is a perspective view of a merchandise support in a supermarket in accordance with the present invention.
FIG. 2 is a bottom view of the shelf showing optional saw lines in any web.
FIG. 3 is a bottom view of the shelf.
FIG. 4 is a cross-sectional view taken along lines 4—4 in FIG. 3.
FIG. 5 is a partial elevation view of the back side of the back.
FIG. 6 is a perspective view of the top edge illustrating how a sign may be used.
FIG. 7 is a cross-sectional view along lines 7—7 in FIG. 6.
FIG. 8 is a cross-sectional view taken along lines 8—8 in FIG. 7.

The composite and complete merchandise support shown in FIG. 1 is arranged on both sides of the permanent supermarket counter construction designated generally by reference numeral 10 which comprises the base 12 on each side having shelves 14 thereon and a center divider 16 therebetween which may be constructed from wood members and plywood and the like. The present merchandise support is designated generally by reference numeral 20 and comprises a back 22 and a bottom or shelf 24 both of which are made from panels of identical construction. Each panel is a wedge-shaped three-dimensional solid panel member constructed from foam plastic material having a flat backside 26 and a tapered or angled frontside 28 leading from a thick edge 30 to a thin edge 32.

The back side 26 of the panel 24 is shown in FIGS. 2 and 3 and in cross-section in FIG. 4 and is molded with depressions or cavities 36 therein leaving solid foam intermediary connected portions 38 which provides a very lightweight construction and saves on material as well as making the material easier to cut with an ordinary handsaw. Sheet material such as "MASONITE", plywood or plastic sheets 40 may be applied to the front 28 and ordinary double-sided adhesive tape 42 may be placed at strategic places for the purpose of securing the sheets 40 as well as securing anything else which needs to be secured. Double-sided adhesive tape is common in the market place and may be obtained from many different sources such as the 3M Company.

Foam plastic material is a common item of commerce and is purchaseable on the market from many different sources the same as wood and other structural materials. It is manufactured from known processes of chemicals and is disclosed in U.S. Pat. Nos. 3,443,276; 3,442,992; 3,336,631; 3,206,899 and 3,336,632 and a copious amount of literature including the following:

| NAME | SOURCE |
|---|---|
| 1. "POLYCEL" FOAM SYSTEMS TECHNICAL DATA BULLETIN 64-01 | POLYTRON COMPANY (date known prior to April, 1969) |
| 2. URETHANE MARKETING GUIDE 1968 | URETHANE INDUSTRY DIGEST 55 East Washington Street Chicago, Illinois 60602 |
| 3. COATINGS AND RESINS "THE SELECTROFOAM STORY" | Pittsburg Plate Glass-PPG Co. PPG INDUSTRIES SPRING of 1967 |
| 4. "FOAM HOME" | UNION CARBIDE COMPANY UNION CARBIDE "WORLD" 1968 |
| 5. "URETHANE FOAM INSULATION" | MOBAY CHEMICAL COMPANY (1951-1961) MOBAY CHEMICAL |
| 6. "RIGID URETHANE FOAM" | UNION CARBIDE COMPANY UNION CARBIDE (c) 1964, 1965 |

A sign 46 made of molded plastic sheet metal or the like has the name of the product or other information thereon and may be temporarily placed on the merchandise support 20. Sign 46 is the form of bent sheet metal or plastic having an upper flange 48 and an elongated lower flange 50 which will fit down behind the back side 26 of the merchandise support 20 back 22. Of course, the sign is readily removable and replaceable.

The back 22 and bottom 24 both may be readily cut by knife, saw or other cutting instrument. For example, in FIG. 2 there are several optional cutting lines or saw lines 54 in the web 56 in the honeycomb arrangement. Thus, a 4 foot piece may be cut into a 3 foot piece or any other increment desired such as a 1 inch c-c dimension, without showing the honeycomb hollow 58 by staying within the web 56. In dimension, for example for supermarket use, the hollows 58 can be laid-out so that if material is cut-off to fit a less deep gondola the hollows 58 will not show as they will be facing the rear of the gondola. This could not be done on present units as structural failure would result because of lack of ribs or wire, etc. in contact with the base gondola.

While I have shown and described a particular form of the merchandise support this is by way of illustration only of a known preferred embodiment and is in no way a limitation since there are various alterations, changes deviations, eliminations, additions, omissions, revisions and departures which may be made in the embodiment shown and described without departing from the scope thereof as defined only by a proper interpretation of the appended claims.

We claim:

1. A lightweight merchandise rack for use on an underlying support counter and comprising, a bottom shelf panel and an upright back panel, each of which is of similar construction, each of said panels being wedge-shaped and having a flat, planar back surface, a flat planar top surface, a wide edge and a narrow edge, said panels being made from lightweight solid plastic foam material which may be cut to desired size with a common instrument, including a knife or an ordinary hand saw to accommodate the panel size to the underlying support counter, said bottom panel having its back surface located in a generally horizontal plane and its wide edge facing to the front of said rack so that the top surface of said bottom panel extends downwardly from the front edge toward the rear of said shelf panel, said upright panel having its back surface located in a generally vertical plane and its wide edge resting atop the rear portion of said top surface of said bottom panel such that the included angle between the top surface of said shelf panel and said top surface of said upright panel is approximately a right angle, and the included angle between said back surface of said shelf panel and said back surface of said upright panel is also approximately a right angle.

2. The display rack of claim 1 which further includes a cover sheet over at least the top surface and wide edge of said shelf panel.

3. The display rack of claim 1 in which said shelf panel and said back panel each have a plurality of regularly recurring recesses formed into the back side thereof, said recesses extending up to but not into said wide edge of said panels so that said wide edge is uninterrupted by said recesses.

* * * * *